US009768566B2

(12) United States Patent
Wilson et al.

(10) Patent No.: US 9,768,566 B2
(45) **Date of Patent: *Sep. 19, 2017**

(54) COAXIAL CABLE CONTINUITY DEVICE

(71) Applicant: PCT International, Inc., Mesa, AZ (US)

(72) Inventors: Brandon Wilson, Phoenix, AZ (US); Paul Sterkeson, Mesa, AZ (US); Timothy L. Youtsey, Scottsdale, AZ (US)

(73) Assignee: PCT International, Inc., Mesa, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/058,091

(22) Filed: Mar. 1, 2016

(65) Prior Publication Data

US 2016/0181742 A1 Jun. 23, 2016

Related U.S. Application Data

(63) Continuation of application No. 14/684,031, filed on Apr. 10, 2015, now Pat. No. 9,577,391, which is a (Continued)

(51) Int. Cl.
*H01R 24/40* (2011.01)
*H01R 9/05* (2006.01)
(Continued)

(52) U.S. Cl.
CPC ..... *H01R 24/40* (2013.01); *H01R 9/05* (2013.01); *H01R 9/0512* (2013.01);
(Continued)

(58) Field of Classification Search
CPC ..... H01R 9/0524; H01R 9/0512; H01R 9/05; H01R 24/40; H01R 24/38; H01R 13/6598
(Continued)

(56) References Cited

U.S. PATENT DOCUMENTS 2,233,216 A 2/1941 Matthysse
2,304,711 A 12/1942 Shenton
(Continued)

FOREIGN PATENT DOCUMENTS

CN 201117964 Y 9/2008
DE 3111832 A1 10/1982
(Continued)

OTHER PUBLICATIONS

Complaint, Connecticut Litigation Case No. 3:12-cv-01468-AVC, filed Oct. 15, 2012, 19 pgs.
(Continued)

*Primary Examiner* — Tulsidas C Patel
*Assistant Examiner* — Travis Chambers
(74) *Attorney, Agent, or Firm* — Perkins Coie LLP

(57) ABSTRACT

A jumper sleeve configured to be installed on an outer side of a male F-connector to facilitate easy connection of and maintain ground continuity across the male F-connector and a female F-connector. In one embodiment, a conductive element is installed on an inner surface of the jumper sleeve and conductively engages an outer surface of the male F-connector to maintain ground continuity across the male and female F-connectors.

35 Claims, 9 Drawing Sheets

Related U.S. Application Data continuation of application No. 13/707,403, filed on Dec. 6, 2012, now Pat. No. 9,028,276.

(60) Provisional application No. 61/567,589, filed on Dec. 6, 2011.

(51) Int. Cl.
*H01R 24/38* (2011.01)
*H01R 13/6598* (2011.01)

(52) U.S. Cl.
CPC ..... *H01R 9/0524* (2013.01); *H01R 24/38* (2013.01); *H01R 13/6598* (2013.01)

(58) Field of Classification Search
USPC ..... 439/578, 322
See application file for complete search history.

(56) References Cited

U.S. PATENT DOCUMENTS

D140,861 S 4/1945 Conlan
3,274,447 A 9/1966 Nelson
3,275,737 A 9/1966 Caller
3,344,227 A 9/1967 Gilmartin et al.
3,366,920 A 1/1968 Laudig et al.
3,390,374 A 6/1968 Forney, Jr.
3,489,988 A 1/1970 Carnaghan
3,517,375 A 6/1970 Mancini
3,544,705 A 12/1970 Winston
3,601,776 A 8/1971 Curl
3,609,651 A 9/1971 Sladek et al.
3,653,689 A 4/1972 Sapy et al.
3,671,922 A 6/1972 Zerlin et al.
3,708,781 A 1/1973 Trompeter
3,740,453 A 6/1973 Callaghan et al.
3,746,931 A 7/1973 Muranaka
3,777,298 A 12/1973 Newman
3,778,535 A 12/1973 Forney, Jr.
3,836,700 A 9/1974 Niemeyer
3,863,111 A 1/1975 Martzloff
3,953,097 A 4/1976 Graham
4,159,859 A 7/1979 Shemtov
4,225,162 A 9/1980 Dola
4,307,926 A 12/1981 Smith
4,377,320 A 3/1983 Lathrop et al.
4,400,050 A 8/1983 Hayward
4,408,822 A 10/1983 Nikitas
4,509,090 A 4/1985 Kawanami et al.
RE31,995 E 10/1985 Ball
4,572,692 A 2/1986 Sauber
4,619,497 A 10/1986 Vogel et al.
4,633,359 A 12/1986 Mickelson et al.
4,684,201 A 8/1987 Hutter
4,718,854 A 1/1988 Capp et al.
4,755,152 A 7/1988 Elliot et al.
4,875,864 A 10/1989 Campbell
4,915,651 A 4/1990 Bout
4,941,846 A 7/1990 Guimond et al.
4,990,106 A 2/1991 Szegda
5,011,432 A 4/1991 Sucht et al.
5,031,981 A 7/1991 Peterson
5,041,020 A 8/1991 Michael
5,067,750 A 11/1991 Minneman
5,073,129 A 12/1991 Szegda
5,083,943 A 1/1992 Tarrant
5,096,444 A 3/1992 Lu et al.
5,123,863 A 6/1992 Frederick et al.
5,141,448 A 8/1992 Mattingly et al.
5,145,382 A 9/1992 Dickirson
5,147,221 A 9/1992 Cull et al.
5,161,993 A 11/1992 Leibfried, Jr.
5,195,905 A 3/1993 Pesci
5,195,910 A 3/1993 Enomoto et al.
5,198,958 A 3/1993 Krantz, Jr.
5,205,547 A 4/1993 Mattingly
5,217,393 A 6/1993 Del Negro et al.
5,237,293 A 8/1993 Kan et al.
5,276,415 A 1/1994 Lewandowski et al.
5,281,167 A 1/1994 Le et al.
5,284,449 A 2/1994 Vaccaro
5,295,864 A 3/1994 Birch et al.
5,297,458 A 3/1994 Smith et al.
5,306,170 A 4/1994 Luu
5,316,348 A 5/1994 Franklin
5,318,458 A 6/1994 Thorner
5,367,925 A 11/1994 Gasparre
5,439,399 A 8/1995 Spechts et al.
5,466,173 A 11/1995 Down
5,470,257 A 11/1995 Szegda
5,498,175 A 3/1996 Yeh et al.
5,507,537 A 4/1996 Meisinger et al.
5,525,076 A 6/1996 Down
5,548,088 A 8/1996 Gray et al.
5,564,938 A 10/1996 Shenkal et al.
5,595,499 A 1/1997 Zander et al.
5,607,325 A 3/1997 Toma
5,632,633 A 5/1997 Roosdorp et al.
5,632,651 A 5/1997 Szegda
5,651,698 A 7/1997 Locati et al.
5,660,565 A 8/1997 Williams
5,667,409 A 9/1997 Wong et al.
5,700,160 A 12/1997 Lee
5,724,220 A 3/1998 Chaudhry
5,730,622 A 3/1998 Olson
5,829,992 A 11/1998 Merker et al.
5,830,010 A 11/1998 Miskin et al.
5,857,711 A 1/1999 Comin-DuMong et al.
5,860,833 A 1/1999 Chillscyzn et al.
5,863,226 A 1/1999 Lan et al.
5,865,654 A 2/1999 Shimirak et al.
5,882,233 A 3/1999 Idehara
5,905,942 A 5/1999 Stoel
5,927,975 A 7/1999 Esrock
5,938,465 A 8/1999 Fox, Sr.
5,953,195 A 9/1999 Pagliuca
5,984,378 A 11/1999 Ostrander et al.
5,991,136 A 11/1999 Kaczmarek et al.
5,992,010 A 11/1999 Zamanzadeh
6,010,349 A 1/2000 Porter, Jr.
6,011,218 A 1/2000 Burek et al.
6,027,373 A 2/2000 Gray et al.
6,042,422 A 3/2000 Youtsey
6,048,233 A 4/2000 Cole
6,065,997 A 5/2000 Wang
6,071,144 A 6/2000 Tang
6,109,963 A 8/2000 Follingstad et al.
6,113,431 A 9/2000 Wong
6,140,582 A 10/2000 Sheehan
6,142,788 A 11/2000 Han
6,146,196 A 11/2000 Burger et al.
6,174,206 B1 1/2001 Yentile et al.
6,183,297 B1 2/2001 Kay et al.
6,183,298 B1 2/2001 Henningsen
6,210,221 B1 4/2001 Maury
6,210,222 B1 4/2001 Langham et al.
6,249,415 B1 6/2001 Daoud et al.
6,250,960 B1 6/2001 Youtsey
6,396,367 B1 5/2002 Rosenberger
D459,306 S 6/2002 Malin
6,425,782 B1 7/2002 Holland
D461,167 S 8/2002 Montena
6,450,836 B1 9/2002 Youtsey
6,468,100 B1 10/2002 Meyer et al.
6,474,201 B1 11/2002 Lund
6,591,055 B1 7/2003 Eslambolchi et al.
6,648,683 B2 11/2003 Youtsey
6,712,631 B1 3/2004 Youtsey
6,767,247 B2 7/2004 Rodrigues et al.
6,798,310 B2 9/2004 Wong et al.
6,808,415 B1 10/2004 Montena
6,817,272 B2 * 11/2004 Holland ..... H01R 43/26 439/304
6,877,996 B1 4/2005 Franks, Jr.

(56) References Cited

U.S. PATENT DOCUMENTS

| | | | | |
|---|---|---|---|---|
| 6,887,102 | B1 | 5/2005 | Burris et al. | |
| D508,676 | S | 8/2005 | Franks, Jr. | |
| 7,018,235 | B1 | 3/2006 | Burris et al. | |
| 7,021,947 | B1 | 4/2006 | Purdy | |
| 7,052,283 | B2 | 5/2006 | Pixley et al. | |
| 7,131,868 | B2 | 11/2006 | Montena | |
| 7,144,273 | B1 | 12/2006 | Chawgo | |
| 7,147,509 | B1 | 12/2006 | Burris et al. | |
| 7,181,999 | B1 | 2/2007 | Skeels et al. | |
| 7,183,743 | B2 | 2/2007 | Geiger | |
| 7,198,495 | B1 | 4/2007 | Youtsey | |
| 7,210,940 | B2 | 5/2007 | Baily et al. | |
| 7,306,484 | B1 | 12/2007 | Mahoney et al. | |
| 7,311,555 | B1 | 12/2007 | Burris et al. | |
| 7,347,129 | B1 | 3/2008 | Youtsey | |
| 7,404,737 | B1 | 7/2008 | Youtsey | |
| 7,500,874 | B2 | 3/2009 | Montena | |
| 7,513,795 | B1 | 4/2009 | Shaw | |
| 7,544,094 | B1 * | 6/2009 | Paglia | H01R 9/0518 439/585 |
| 7,566,236 | B2 | 7/2009 | Malloy et al. | |
| 7,635,283 | B1 | 12/2009 | Islam | |
| 7,785,144 | B1 | 8/2010 | Islam | |
| 7,824,216 | B2 | 11/2010 | Purdy | |
| 7,837,501 | B2 * | 11/2010 | Youtsey | H01R 24/40 439/445 |
| 7,841,912 | B2 | 11/2010 | Hachadorian | |
| 7,857,661 | B1 | 12/2010 | Islam | |
| 7,887,354 | B2 | 2/2011 | Holliday | |
| 7,997,930 | B2 * | 8/2011 | Ehret | H01R 13/622 439/320 |
| 8,016,605 | B2 * | 9/2011 | Montena | H01R 13/622 439/322 |
| 8,016,612 | B2 * | 9/2011 | Burris | H01R 9/05 439/578 |
| 8,029,315 | B2 | 10/2011 | Purdy et al. | |
| 8,029,316 | B2 * | 10/2011 | Snyder | H01R 9/05 439/578 |
| 8,062,064 | B2 | 11/2011 | Rodrigues et al. | |
| 8,065,940 | B2 * | 11/2011 | Wilson | B25B 13/06 81/467 |
| 8,075,338 | B1 | 12/2011 | Montena | |
| 8,079,860 | B1 | 12/2011 | Zraik | |
| 8,113,875 | B2 | 2/2012 | Malloy et al. | |
| 8,113,879 | B1 | 2/2012 | Zraik | |
| 8,152,551 | B2 | 4/2012 | Zraik | |
| 8,157,588 | B1 * | 4/2012 | Rodrigues | H01R 13/622 439/578 |
| 8,157,589 | B2 | 4/2012 | Krenceski et al. | |
| 8,172,611 | B1 | 5/2012 | Montena | |
| 8,206,176 | B2 | 6/2012 | Islam | |
| 8,231,412 | B2 | 7/2012 | Paglia et al. | |
| 8,337,229 | B2 * | 12/2012 | Montena | H01R 9/05 439/322 |
| 8,342,879 | B2 | 1/2013 | Amidon et al. | |
| 8,388,377 | B2 | 3/2013 | Zraik | |
| 8,414,313 | B2 | 4/2013 | Rodrigues et al. | |
| 8,444,445 | B2 | 5/2013 | Amidon et al. | |
| 8,465,322 | B2 | 6/2013 | Purdy | |
| 8,490,525 | B2 | 7/2013 | Wilson et al. | |
| 8,568,164 | B2 | 10/2013 | Ehret et al. | |
| 8,794,113 | B2 | 8/2014 | Maury | |
| 8,808,019 | B2 | 8/2014 | Paglia et al. | |
| 8,920,182 | B2 * | 12/2014 | Montena | H01R 9/05 439/215 |
| 8,920,192 | B2 * | 12/2014 | Montena | H01R 9/05 439/320 |
| 9,027,446 | B1 | 5/2015 | Simkin et al. | |
| 9,028,276 | B2 * | 5/2015 | Wilson | H01R 9/0524 439/578 |
| 9,362,666 | B2 * | 6/2016 | Laughlin | H01R 13/629 |
| 2002/0090856 | A1 | 7/2002 | Weisz-Margulescu | |
| 2003/0046706 | A1 | 3/2003 | Rakib | |
| 2004/0048514 | A1 | 3/2004 | Kodaira | |
| 2004/0112356 | A1 | 6/2004 | Hatcher | |
| 2004/0194585 | A1 | 10/2004 | Clark | |
| 2005/0148236 | A1 | 7/2005 | Montena | |
| 2005/0272311 | A1 | 12/2005 | Tsao | |
| 2006/0041922 | A1 | 2/2006 | Shapson | |
| 2006/0154522 | A1 | 7/2006 | Bernhart et al. | |
| 2006/0172571 | A1 | 8/2006 | Montena | |
| 2008/0066584 | A1 | 3/2008 | Vines | |
| 2008/0311790 | A1 | 12/2008 | Malloy et al. | |
| 2008/0313691 | A1 | 12/2008 | Cholas et al. | |
| 2008/0318469 | A1 * | 12/2008 | Paglia | H01R 43/24 439/578 |
| 2010/0022120 | A1 | 1/2010 | Bradley | |
| 2010/0233902 | A1 | 9/2010 | Youtsey | |
| 2010/0297875 | A1 | 11/2010 | Purdy et al. | |
| 2011/0287653 | A1 | 11/2011 | Youtsey | |
| 2011/0318958 | A1 | 12/2011 | Burris et al. | |
| 2012/0045933 | A1 | 2/2012 | Youtsey | |
| 2012/0129387 | A1 | 5/2012 | Holland et al. | |
| 2012/0295464 | A1 | 11/2012 | Youtsey | |
| 2012/0295465 | A1 | 11/2012 | Youtsey | |
| 2012/0295466 | A1 | 11/2012 | Youtsey | |
| 2013/0029513 | A1 | 1/2013 | Montena | |
| 2013/0130544 | A1 | 5/2013 | Wei | |
| 2013/0143438 | A1 | 6/2013 | Wilson et al. | |
| 2014/0051285 | A1 | 2/2014 | Raley et al. | |
| 2015/0111429 | A1 * | 4/2015 | Hoyak | H01R 9/05 439/607.17 |
| 2015/0295368 | A1 * | 10/2015 | Wilson | H01R 9/0524 439/578 |
| 2015/0325932 | A1 * | 11/2015 | Ehret | H01R 13/622 439/584 |

FOREIGN PATENT DOCUMENTS

| | | | |
|---|---|---|---|
| GB | 2079549 | A | 1/1982 |
| JP | 64002263 | A | 1/1989 |
| JP | 2299182 | A | 12/1990 |
| JP | 05347170 | A | 12/1993 |
| TW | 570415 | U | 1/2004 |
| TW | I297633 | B | 6/2008 |
| WO | WO-9310578 | A1 | 5/1993 |
| WO | WO-2011146911 | A1 | 11/2011 |
| WO | WO-2012158343 | A1 | 11/2012 |
| WO | WO-2012158344 | A1 | 11/2012 |
| WO | WO-2012158345 | A1 | 11/2012 |

OTHER PUBLICATIONS

File History of U.S. Pat. No. 7,544,094 issued Jun. 9, 2009, 123 pgs.
Declaration of James Dickens, Ph.D. re 7,544,094 patent, with Curriculum Vitae, Apr. 2, 2013, 35 pages.
Holden, G. et al., "Applications of Thermoplastic Elastomers", Thermoplastic Elastomers, Hanser Gardner Publications, Inc., 2004, 3 pgs.
Pasternack Enterprises, LLC, Catalog #2003-SA, 2003, pp. 171-172.

* cited by examiner

COAXIAL CABLE CONTINUITY DEVICE

CROSS-REFERENCE TO RELATED APPLICATION(S)

This application is a continuation of U.S. patent application Ser. No. 14/684,031, filed Apr. 10, 2015, which is a continuation of U.S. patent application Ser. No. 13/707,403, filed Dec. 6, 2012, now U.S. Pat. No. 9,028,276, which claims the benefit to U.S. Provisional Patent Application No. 61/567,589, filed Dec. 6, 2011, the disclosures of which are incorporated herein by reference in their entireties.

TECHNICAL FIELD

The following disclosure relates generally to devices for facilitating connection, reducing RF interference, and/or grounding of F-connectors and other cable connectors.

BACKGROUND

Electrical cables are used in a wide variety of applications to interconnect devices and carry audio, video, and Internet data. One common type of cable is a radio frequency (RF) coaxial cable ("coaxial cable") which may be used to interconnect televisions, cable set-top boxes, DVD players, satellite receivers, and other electrical devices. Conventional coaxial cable typically consists of a central conductor (usually a copper wire), dielectric insulation, and a metallic shield, all of which are encased in a polyvinyl chloride (PVC) jacket. The central conductor carries transmitted signals while the metallic shield reduces interference and grounds the entire cable. When the cable is connected to an electrical device, interference may occur if the grounding is not continuous across the connection with the electrical device.

A connector, such as an "F-connector" (e.g., a male F-connector), is typically fitted onto an end of the cable to facilitate attachment to an electrical device. Male F-connectors have a standardized design, using a hexagonal rotational connecting ring with a relatively short length available for finger contact. The internal threads on the connecting ring require the male connector to be positioned exactly in-line with a female F-connector for successful thread engagement as rotation begins. The male F-connector is designed to be screwed onto and off of the female F-connector using the fingers. However, the relatively small surface area of the rotational connecting ring of the male F-connector can limit the amount of torque that can be applied to the connecting ring during installation. This limitation can result in a less than secure connection, especially when the cable is connected to the device in a location that is relatively inaccessible. Accordingly, it would be advantageous to facilitate grounding continuity across cable connections while facilitating the application of torque to, for example, a male F-connector during installation.

DETAILED DESCRIPTION

Figure 1:
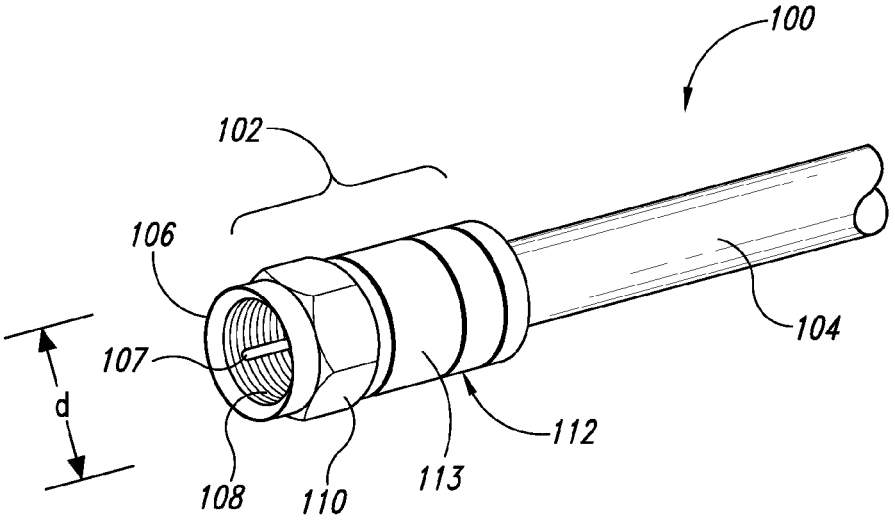
FIG. 1 is an isometric view of a coaxial cable having an F-type male connector.

The following disclosure describes apparatuses, systems, and associated methods for facilitating ground continuity across a connection of a coaxial cable and/or reducing RF interference of a signal carried by the coaxial cable. Certain details are set forth in the following description and in FIGS. 1-5E to provide a thorough understanding of various embodiments of the disclosure. Those of ordinary skill in the relevant art will appreciate, however, that the technology disclosed herein can have additional embodiments that may be practiced without several of the details described below and/or with additional features not described below. In addition, some well-known structures and systems often associated with coaxial cable connector systems and methods have not been shown or described in detail below to avoid unnecessarily obscuring the description of the various embodiments of the disclosure.

The dimensions, angles, features, and other specifications shown in the figures are merely illustrative of particular embodiments of the disclosure. Accordingly, other embodiments can have other dimensions, angles, features, and other specifications without departing from the scope of the present disclosure. In the drawings, identical reference numbers identify identical, or at least generally similar, elements. To facilitate the discussion of any particular element, the most significant digit or digits in any reference number refers to the figure in which that element is first introduced. For example, element 222 is first introduced and discussed with reference to FIG. 2.

FIG. 1 is an isometric view of a cable assembly 100 having a connector, for example, a male F-connector 102 attached to an end portion of a coaxial cable 104. The coaxial cable 104 has a central conductor 107. The male F-connector 102 has a rotatable connecting ring 106 having a diameter d with a threaded inner surface 108 and a hexagonal outer surface 110. A sleeve assembly 112 having an outer surface 113 is compressed onto an exposed metal braid (not shown) of the coaxial cable 104 in a manner well known in the art.

Figure 2A:
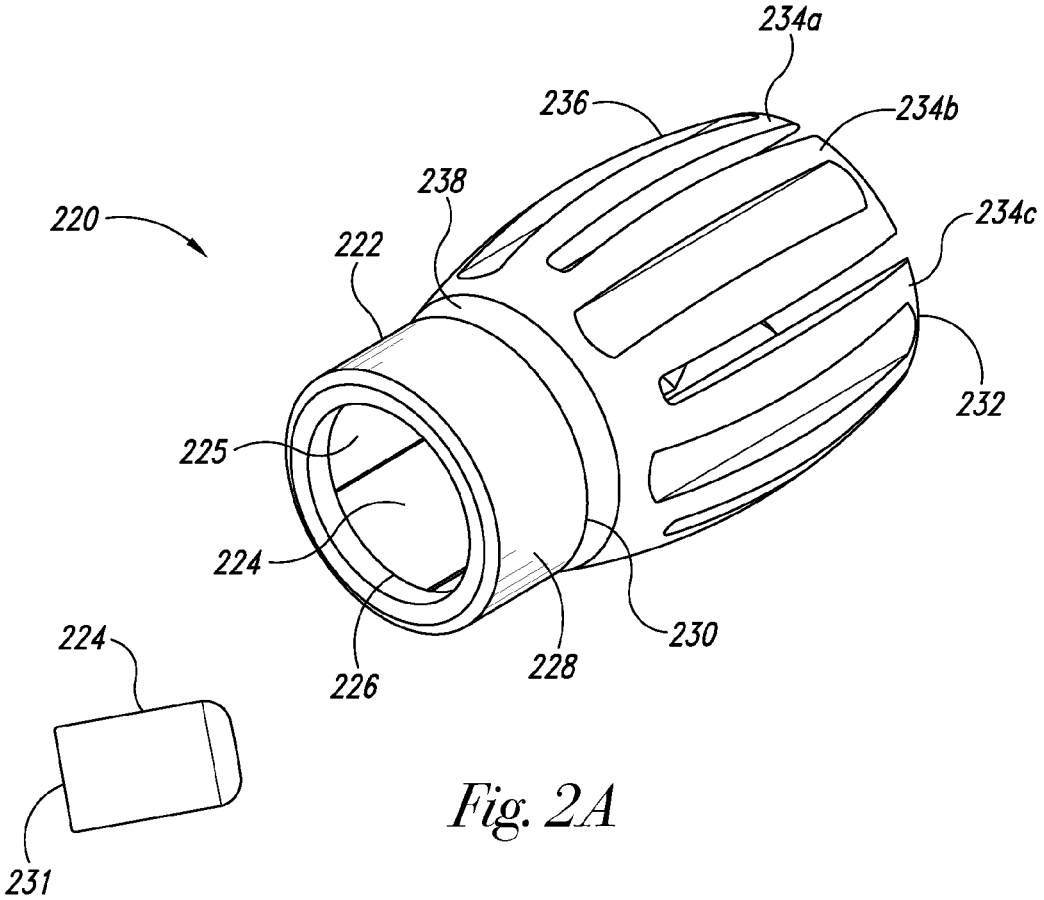
FIG. 2A is an isometric view of a jumper sleeve having a ground continuity element configured in accordance with an embodiment of the present disclosure.
Figure 2B:
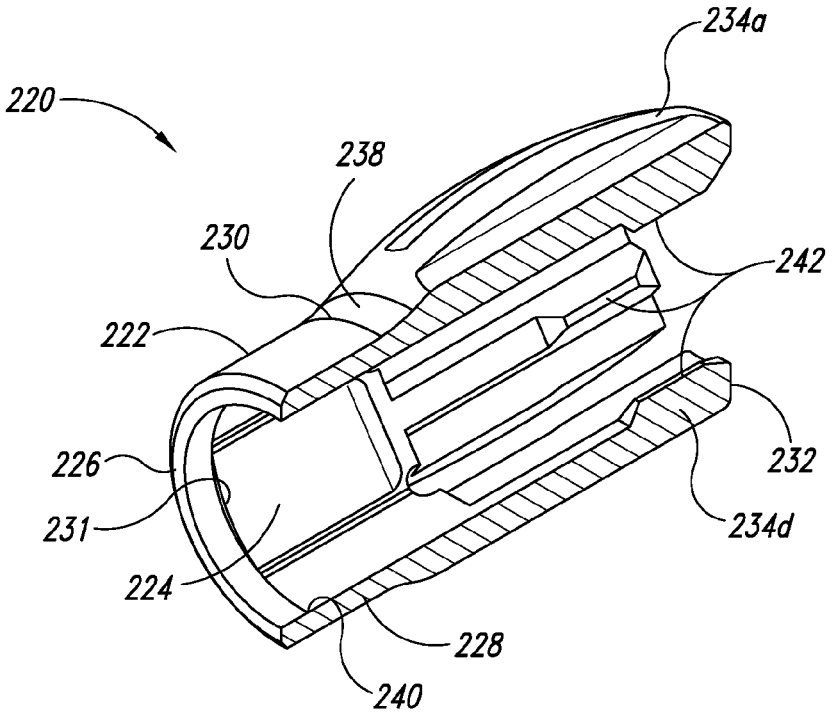
FIG. 2B is an isometric cross-sectional view of a jumper sleeve having a ground continuity element configured in accordance with an embodiment of the present disclosure.
Figure 2C:
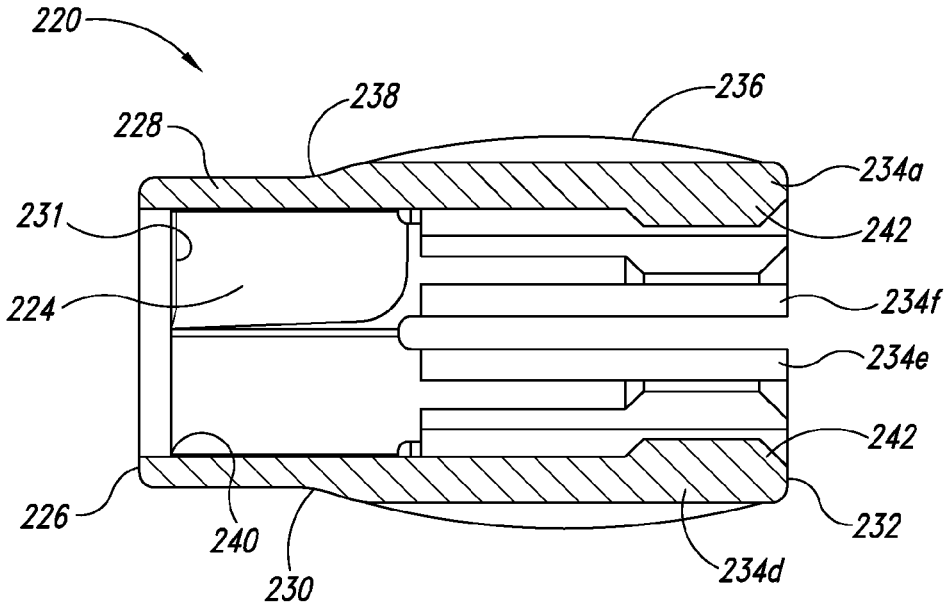
FIG. 2C is a side cross-sectional view of a jumper sleeve having a ground continuity element configured in accordance with an embodiment of the present disclosure.

FIGS. 2A-2C are isometric, isometric cross-sectional, and side cross-sectional views, respectively, of a jumper sleeve 220 configured in accordance with an embodiment of the disclosure. The jumper sleeve 220 has a generally tubular body with a wrench portion 222 and a grip portion 236. The wrench portion 222 has a hollow wrench body 228 extending between a proximal end 223 and a distal end 230. The wrench body 228 has a front opening 226 and a shaped inner surface 225 configured to receive and at least partially grip the hexagonal outer surface 110 of the male F-connector 102 (FIG. 1). In the illustrated embodiment, for example, the inner surface 225 has a hexagonal shape. In other embodiments, the inner surface 225 can have other shapes and features to facilitate receiving and/or gripping the male connector 102. In some embodiments, the jumper sleeve 220 can be made from, for example, plastic, rubber, and/or metal. While in other embodiments, the jumper sleeve may be made from other suitable materials known in the art.

In one aspect of this embodiment, a ground continuity element 224 is attached to a portion of the hexagonal inner surface 225. The ground continuity element 224 is configured to conductively engage the hexagonal outer surface 110 of the connecting ring 106 and the outer surface 113 of the sleeve assembly 112 to maintain ground continuity throughout the coaxial cable assembly 100 when connected to an electrical device and/or other cable. In the illustrated embodiment, the ground continuity element 224 is a resilient, thin metal plate made from, for example, a conductive material such as copper beryllium, brass, etc. In other embodiments, the ground continuity element 224 can be made from other suitable conductive materials known in the art. Furthermore, in the illustrated embodiment, there is one ground continuity element 224. However, in other embodiments, two or more ground continuity elements 224 may be positioned circumferentially around the inner surface 225 of the wrench body 228.

In the illustrated embodiment of FIGS. 2A-2C, the grip portion 236 is a cask-shaped hollow member having a proximal end 238 and a distal end 232. A plurality of convex grip members 234 (identified individually as grip members 234*a*-234*f*) extend away from the proximal end 238 of the grip portion 236. When the male F-connector 102 is inserted into the jumper sleeve 220, the grip members 234 allow for application of greater torque to the rotatable connecting ring 106 than could otherwise be achieved with direct manual rotation of the hexagonal outer surface 110 of the male F-connector 102. As shown in FIG. 2B, an inner key 242 protrudes from each of the grip members 234 to retain the male F-connector 102 in the jumper sleeve 220 and preventing its egress from the distal end 232 of the grip portion 236. Similarly, a shoulder portion 240 is configured to prevent the male F-connector 102 from slipping out of the proximal end 238 of the wrench body 228. In this way, the jumper sleeve 220 can be configured for permanent attachment to the male F-connector 102. In some embodiments, however, the jumper sleeve 220 can be configured to be releasably attached to the male F-connector.

Figure 2D:
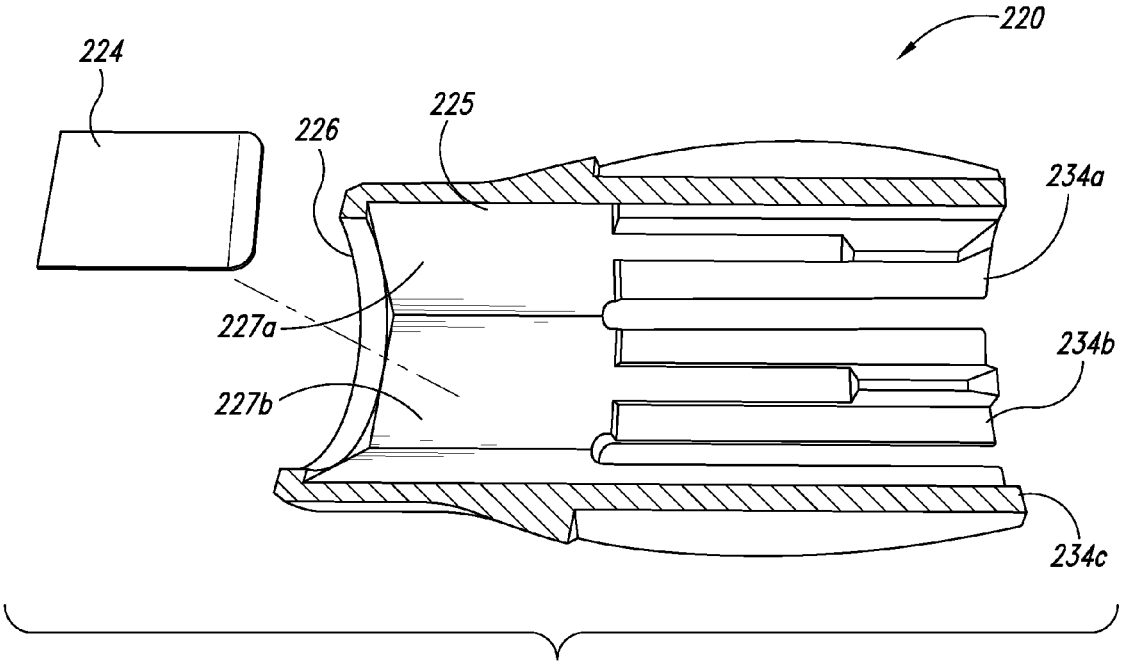
FIGS. 2D and 2E are isometric cross-sectional views of the jumper sleeve 220 prior to and after, respectively, installation of the ground continuity element 224 in accordance with an embodiment of the present disclosure.
Figure 2E:
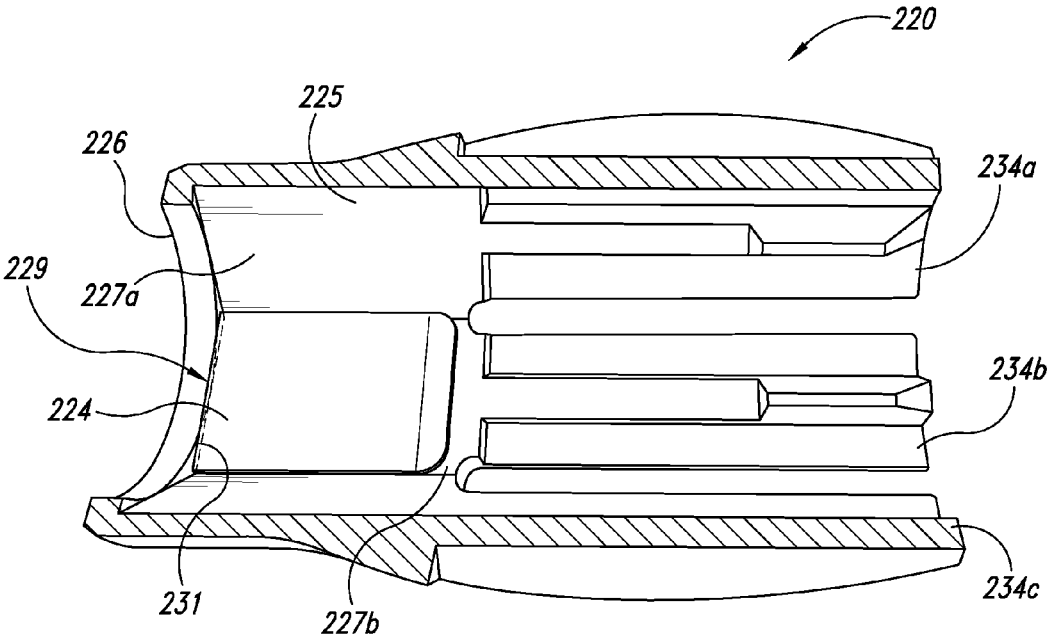

FIGS. 2D and 2E are side cross-sectional views of the jumper sleeve 220 prior to and after, respectively, installation of the ground continuity element 224 in accordance with an embodiment of the present disclosure. FIG. 2D depicts the ground continuity element 224 prior to installation in the jumper sleeve 220. A plurality of longitudinal inner grooves 227 (identified individually as grooves 227*a*-*c*) is circumferentially formed around the inner surface 225. Each of the grooves 227 is configured to receive and/or releasably engage an individual ground continuity element 224. For example, the grooves 227 can have a shape and/or depth suitable for snapping around or otherwise accepting the ground continuity element 224, holding it in place within the jumper sleeve 220.

FIG. 2E depicts the ground continuity element 224 after installation in the jumper sleeve 220. An operator can install the ground continuity element 224 by first inserting a leading edge portion 231 of the ground continuity element 224 through the distal end 232 (FIG. 2A) of the jumper sleeve 220 toward the opening 226. In the illustrated embodiment, the leading edge portion 231 snaps into the groove 227*b*, and the jumper sleeve 220 is ready to be installed onto a male F-connector. In some embodiments, the leading edge portion 231 can slide or otherwise releasably engage a lateral lip or slot 229 formed along an internal surface portion of the adjacent opening 226. In other embodiments, the ground continuity element 224 can be cast into, bonded, welded, or otherwise integrated or attached to the jumper sleeve 220 during manufacture.

Figure 3A:
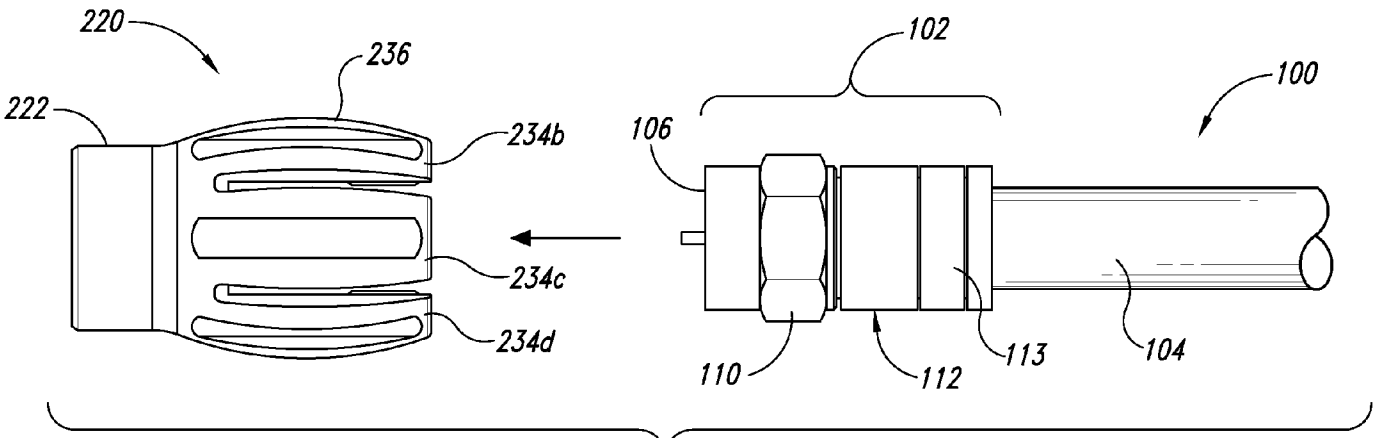
FIG. 3A is a side view of a jumper sleeve and a coaxial cable prior to installation of the jumper sleeve in accordance with an embodiment of the present disclosure.
Figure 3B:
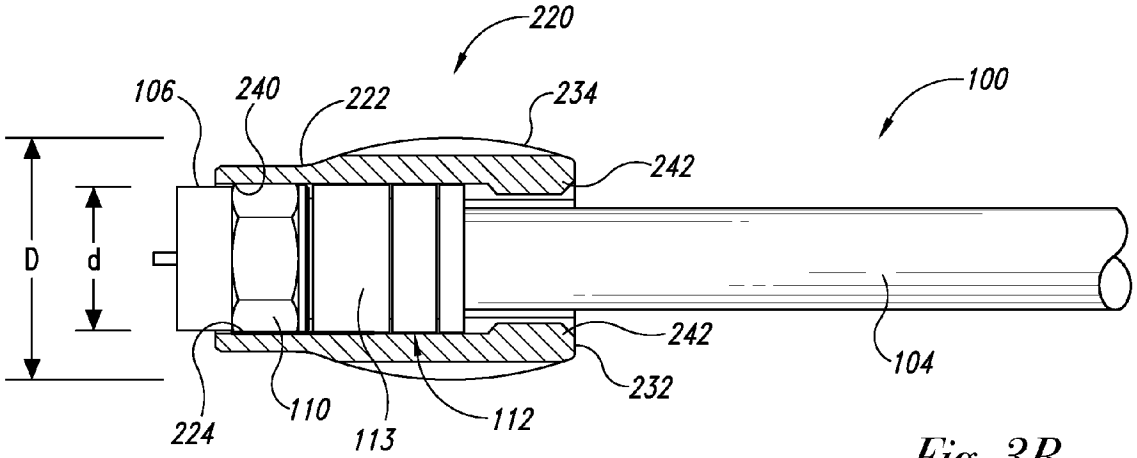
FIG. 3B is a cross-sectional side view of the jumper sleeve and coaxial cable of FIG. 3A after installation of the jumper sleeve in accordance with an embodiment of the present disclosure.

FIG. 3A depicts the coaxial cable assembly 100 before installation of the jumper sleeve 220. FIG. 3B illustrates a side view of the coaxial cable assembly 100 and a cross-sectional view of the jumper sleeve 220 after installation of the jumper sleeve 220. Referring to FIGS. 3A and 3B together, during installation, the male F-connector 102 is fully inserted into the jumper sleeve 220. The inner surface 225 of the wrench body 228 accepts the hexagonal outer surface 110 of the male F-connector 102, and the inner keys 242 and the shoulder portion 240 retain the male F-connector 102 in the jumper sleeve 220.

A larger outer diameter D and corresponding larger surface area of the gripping portions 234 offer a mechanical advantage for applying increased torque to the rotatable connecting ring 106 of the male F-connector 102 during installation. Thus, the jumper sleeve 220 facilitates a more efficient and secure connection of the male F-connector 102 to a female F-connector than might be achievable without the jumper sleeve 220. As shown in FIG. 3B, the ground continuity element 224 is retained in situ between the jumper sleeve 220, hexagonal outer surface 110, and the outer surface 113 of the sleeve assembly 112. The ground continuity element 224 conductively engages or contacts one of the "flats" of the hexagonal outer surface 110 and the outer surface 113 to maintain a metal-to-metal ground path throughout the male F-connector 102 and the coaxial cable 104, thereby enhancing signal quality.

Figure 4A:
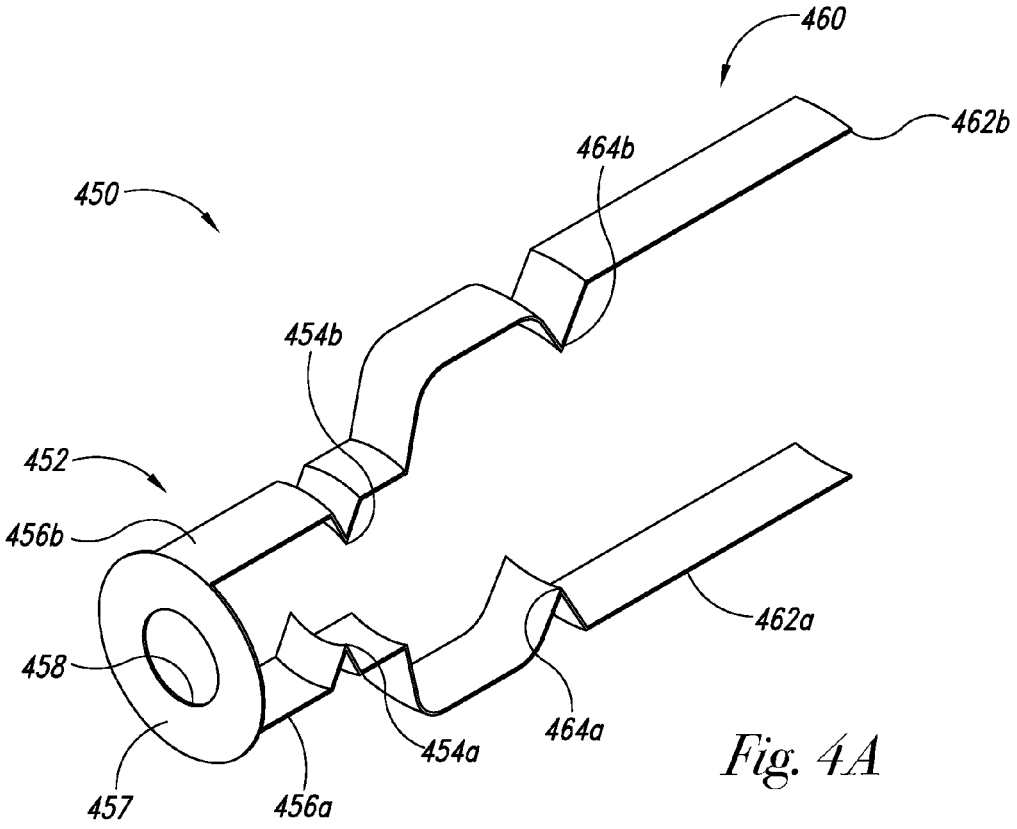
FIG. 4A is an isometric view of a ground continuity element in accordance with another embodiment of the disclosure.
Figure 4B:
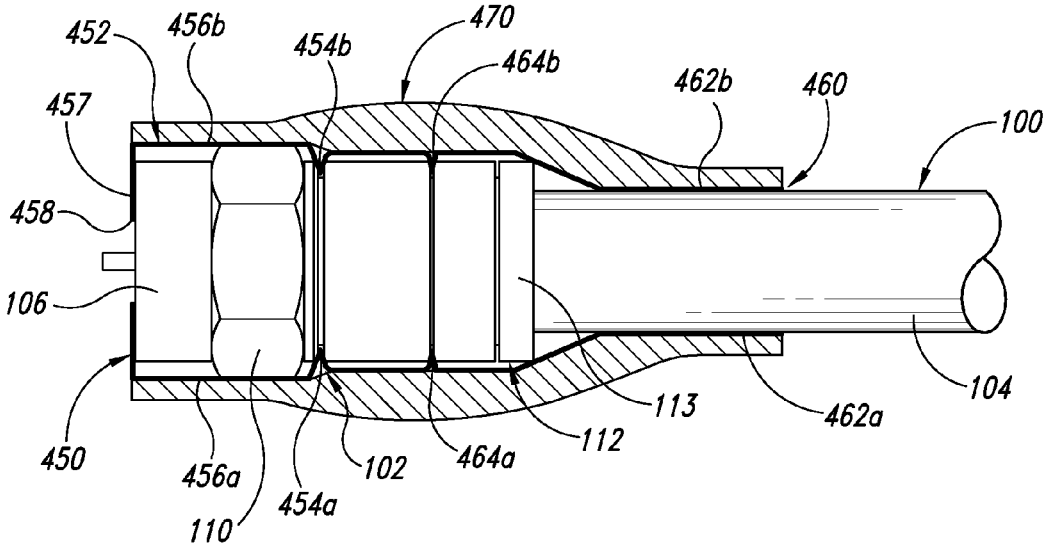
FIG. 4B is a side cross-sectional view of a jumper sleeve having the ground continuity element of FIG. 4A installed therein.

FIG. 4A is an isometric view of a ground continuity element 450 configured in accordance with another embodiment of the disclosure. FIG. 4B is a side cross-sectional side view of the ground continuity element 450 installed in a jumper sleeve 470 that is installed onto the coaxial cable assembly 100. Referring first to FIG. 4A, the ground continuity element 450 includes a proximal end portion 452 and a distal end portion 460. The proximal end portion 452 is configured to conductively engage the connecting ring 106 of the male F-connector 102 of the coaxial cable assembly 100. The distal end portion 460 includes one or more tines 462 (referred to individually as a first tine 462*a* and a second tine 462*b*). The tines 462 each have a shield protrusion 464

(identified individually as a first shield protrusion 464*a* and a second shield protrusion 462*b*) configured to conductively engage or contact the outer surface 113 of the sleeve assembly 112 of the male F-connector 102. Each tine 462 also includes a ring protrusion 454 (identified individually as a first ring protrusion 454*a* and a second ring protrusion 454*b*) near the proximal portion 452. The ring protrusions 454 are configured to conductively engage or contact the connecting ring 106. The hexagonal elements 456 (identified individually as a first hexagonal element 456*a* and a second hexagonal element 456*b*) are similarly configured to conductively engage the hexagonal outer surface 110 of the connecting ring 110. A front annular panel 457 is configured to be sandwiched between the male F-connector 102 and a corresponding female connector, or otherwise conductively engage the female F-connector when the male F-connector 102 is fully installed. An aperture or central hole 458 in the panel 457 allows the central conductor 107 of the coaxial cable 104 to pass therethrough for suitable engagement with a corresponding female F-connector.

Figure 5A:
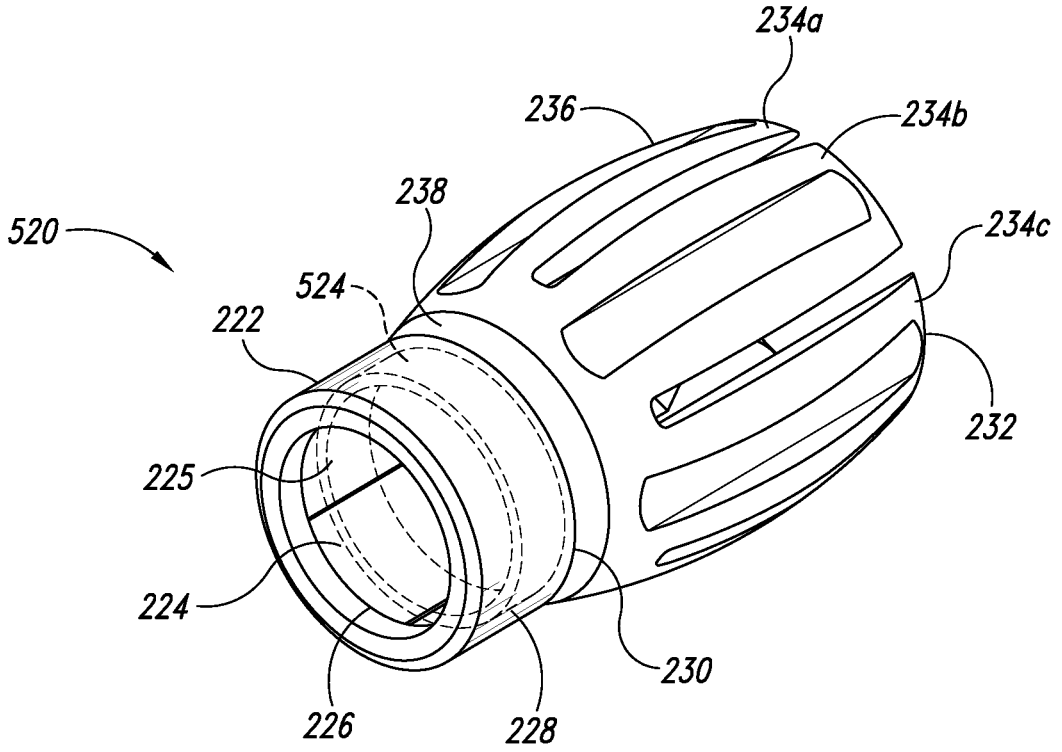
FIGS. 5A-5C are isometric, isometric cross-sectional, and side cross-sections views, respectively, of a jumper sleeve having a ferrite element configured in accordance with an embodiment of the present disclosure.
Figure 5B:
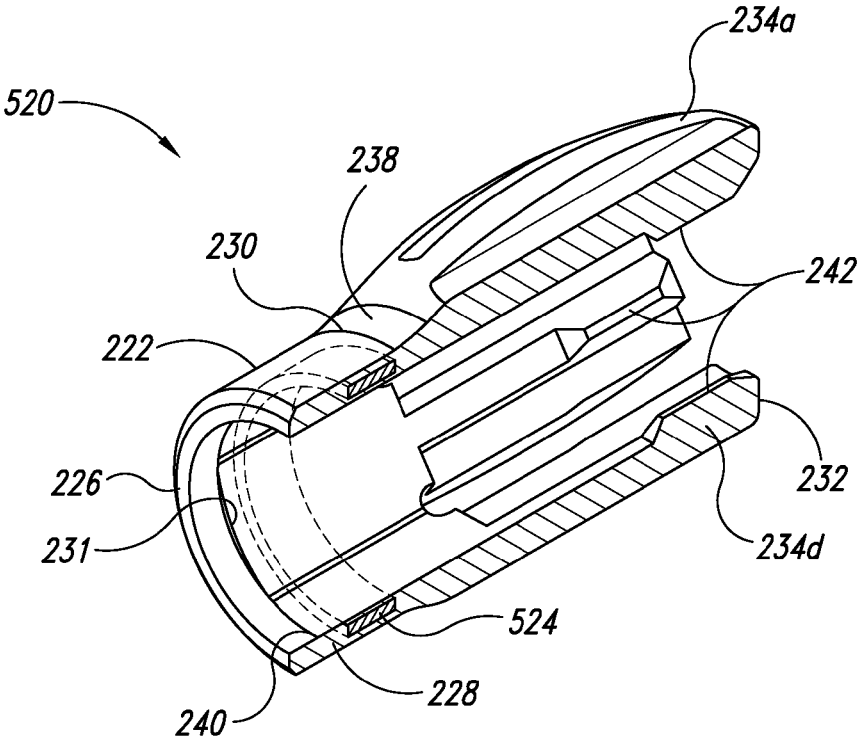
Figure 5C:
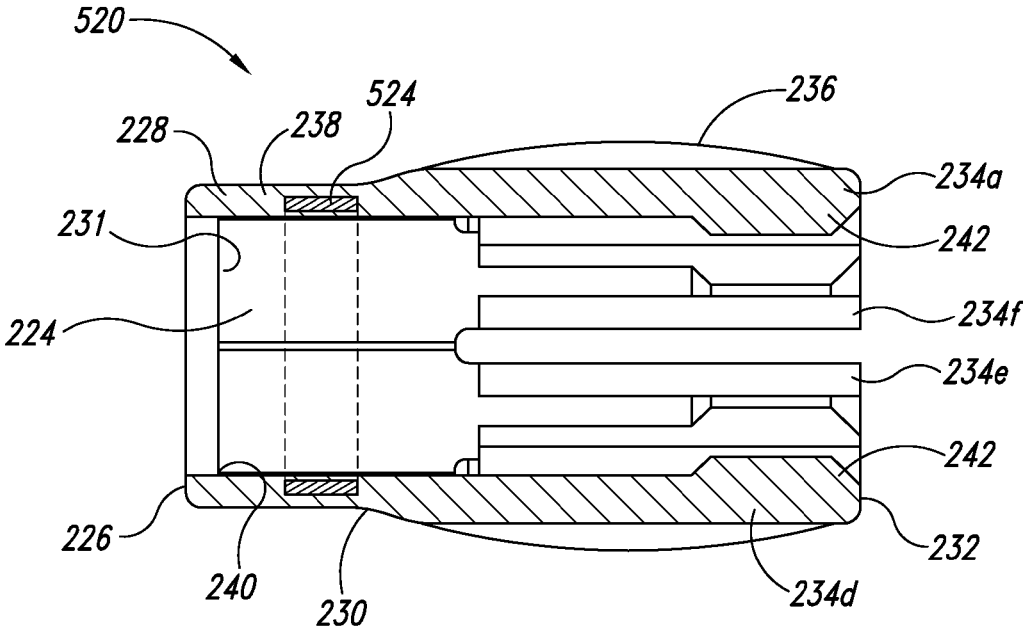

FIGS. 5A-5C are isometric, isometric cross-sectional, and side cross-sectional views, respectively, of a jumper sleeve 520 having a ferrite core or a ferrite element 524 configured in accordance with an embodiment of the disclosure. The ferrite element 524 may be disposed in, on, and/or around a portion of the jumper sleeve 520. The ferrite element 524 can be made from any suitable permanently or temporarily magnetic material. For example, the ferrite element 524 can be made from one or more soft ferrites such as (but not limited to) iron ferrite, manganese ferrite, manganese zinc ferrite, and nickel zinc ferrite.

Referring to FIGS. 5A-5C together, the ferrite element 524 can be formed into a ring that is circumferentially disposed within the wrench portion 222. While the ferrite element 524 is shown in FIGS. 5A-5C as having a length that is less than the total length of the wrench portion 222, in other embodiments, for example, the ferrite element 524 can have a shorter or longer length. In some embodiments, for example, the ferrite element can have a length that is equal to or greater than the length of the wrench portion 222 (e.g., the ferrite element can extend into and/or onto the grip portion 236). In further embodiments, for example, the entire jumper sleeve 520 can be made from the ferrite element 524.

In the illustrated embodiment of FIGS. 5A-5C, the ferrite element 524 is shown as a ring or a band embedded within the jumper sleeve 520. In other embodiments, however, the ferrite element 524 can have any suitable shape (e.g., a coil, a helix, a double helix) in and/or around the jumper sleeve 520. In some embodiments, for example, the ferrite element 524 can have roughly the same shape (e.g., a hexagonal tube or core) as the shaped inner surface 225. Furthermore, in the illustrated embodiment, the ferrite element 524 is shown as having approximately the same thickness as the jumper sleeve 520. In other embodiments, however, the ferrite element 524 can have any suitable thickness. As discussed in further detail below, it may be advantageous, for example, to vary the thickness of the ferrite element 524 to attenuate a particular frequency range of RF interference.

Figure 5D:
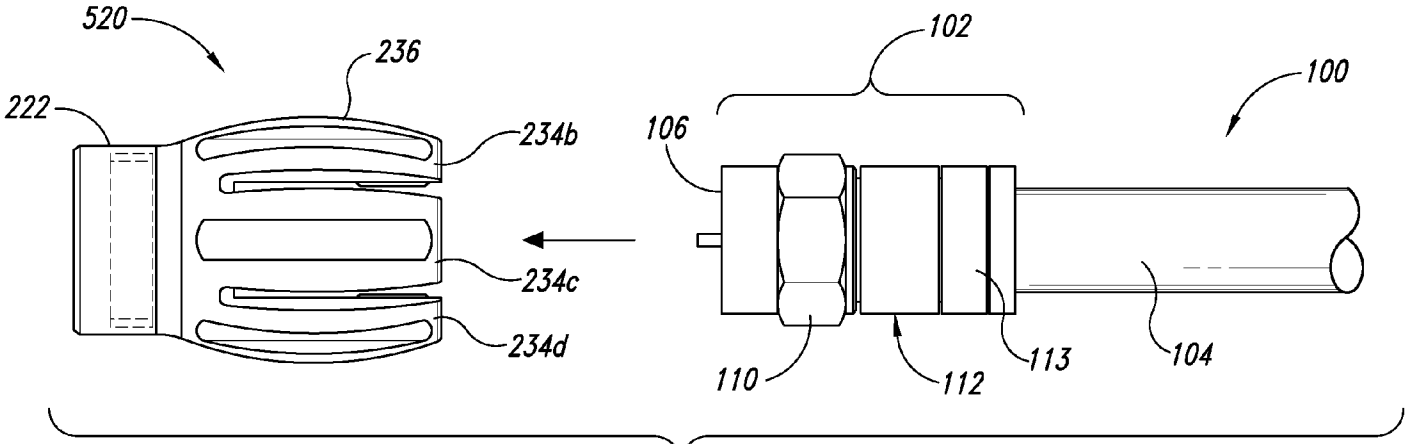
FIG. 5D is a side view of a jumper sleeve and a coaxial cable prior to installation of the jumper sleeve in accordance with an embodiment of the present disclosure.
Figure 5E:
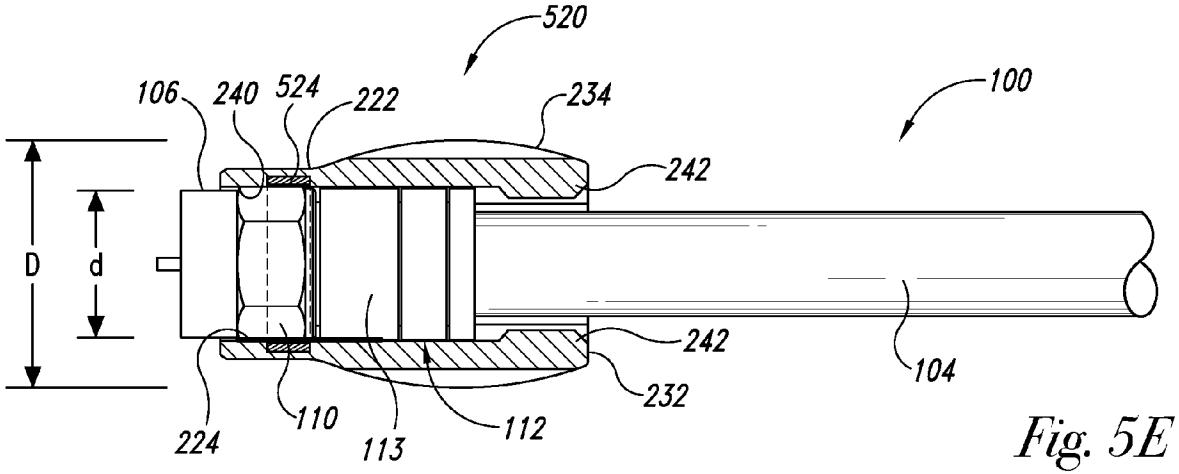
FIG. 5E is a cross-sectional side view of the jumper sleeve and coaxial cable of FIG. 5D after installation of the jumper sleeve in accordance with an embodiment of the present disclosure.

FIG. 5D depicts the coaxial cable assembly 100 before installation of the jumper sleeve 520. FIG. 5E illustrates a side view of the coaxial cable assembly 100 and a cross-sectional view of the jumper sleeve 520 after installation of the jumper sleeve 520. Referring to FIGS. 5D and 5E together, during installation, the male F-connector 102 is fully inserted into the jumper sleeve 520. In the illustrated embodiment, the jumper sleeve 520 is lockably fitted to the male F-connector 102. In other embodiments, however, the jumper sleeve 520 can be configured to be removable to facilitate use on one or more other cable assemblies 100.

As those of ordinary skill in the art will appreciate, placing a ferrite material at or near a cable termination can be effective in suppressing interference of a signal carried by a coaxial cable. The present technology offers the advantage of placing a ferrite material (e.g., the ferrite element 524) very proximate to the male F-connector 102 while aiding in the fitment of the male F-connector 102 to a female F-connector. As those of ordinary skill in the art will further appreciate, for example, an RF shield current can form along an outer surface of the cable 104 shield or jacket, causing RF interference in a signal carried by the cable 104 (e.g., a signal carried by the central conductor 107). Placing the jumper sleeve 520 (having the ferrite element 524 therein and/or thereon) onto the male F-connector 102, however, can reduce RF interference of a signal carried within the cable 104 by attenuating the RF shield current along the cable 104 more effectively than, for example, the jumper sleeve 520 alone. The ferrite element 524 can be further configured to attenuate particular frequencies of RF interference by adjusting, for example, the width and/or the thickness of the ferrite element 524. The effectiveness of the ferrite element 524 can be further adjusted, for example, by varying the impedance of the ferrite element 524; the chemical composition of the ferrite element 524; and/or the number of turns of the ferrite element 524 around the cable 104

Figure 5F:
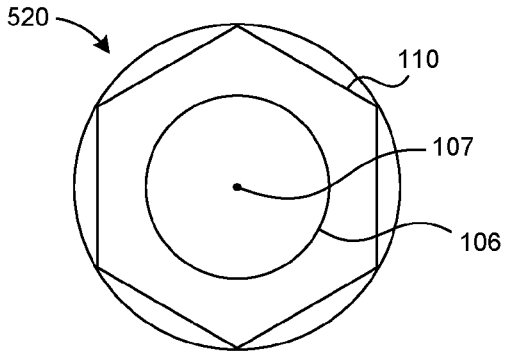
FIGS. 5F and 5G are front schematic views of a jumper sleeve in a clamshell configuration in accordance with an embodiment of the present disclosure.
Figure 5G:
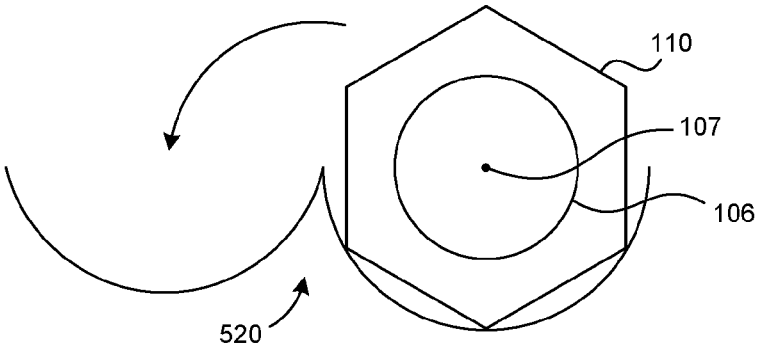

In some embodiments, for example, the ferrite element 524 can be configured to be retrofitted or otherwise placed in and/or on the jumper sleeve 520 after fitment to the male F-connector 102. For example, as shown in FIGS. 5F and 5G, the jumper sleeve 520 and/or the ferrite element 524 can be configured in a removable clamshell configuration. In some other embodiments, for example, a groove (not shown) can be formed on an external surface of the jumper sleeve 520 (e.g., along the wrench portion 222) and configured to receive the ferrite element 524 for installation after the jumper sleeve 520 has already been attached to the male F-connector 102. In some further embodiments, the jumper sleeve 520 can be configured to receive additional and/or different ferrite elements 524 based on cable configuration and/or conditions. For example, an additional ferrite element 524 can be added to the jumper sleeve 520 already having a ferrite element 524 therein and/or thereon. As those of ordinary skill in the art will appreciate, adding one or more additional ferrite elements 524 may have the effect of further reducing RF interference within the cable. In yet further embodiments, the ferrite element 524 can be configured as a wire having one or more coils in and/or around the jumper sleeve 520.

The foregoing description of embodiments of the invention is not intended to be exhaustive or to limit the disclosed technology to the precise embodiments disclosed. While specific embodiments of, and examples for, the invention are described herein for illustrative purposes, various equivalent modifications are possible within the scope of the invention, as those of ordinary skill in the relevant art will recognize. For example, although certain functions may be described in the present disclosure in a particular order, in alternate embodiments these functions can be performed in a different order or substantially concurrently, without departing from the spirit or scope of the present disclosure. In addition, the teachings of the present disclosure can be applied to other systems, not only the representative coin sorting systems described herein. Further, various aspects of the invention described herein can be combined to provide yet other embodiments.

In general, the terms used in the following claims should not be construed to limit the invention to the specific embodiments disclosed in the specification, unless the above-detailed description explicitly defines such terms. Accordingly, the actual scope of the disclosure encompasses the disclosed embodiments and all equivalent ways of practicing or implementing the disclosure under the claims.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below," and words of similar import, when used in this application, shall refer to this application as a whole and not to any particular portions of this application. When the claims use the word "or" in reference to a list of two or more items, that word covers all of the following interpretations of the word: any of the items in the list, all of the items in the list, and any combination of the items in the list.

From the foregoing, it will be appreciated that specific embodiments of the disclosed technology have been described herein for purposes of illustration, but that various modifications may be made without deviating from the invention. Certain aspects of the disclosure described in the context of particular embodiments may be combined or eliminated in other embodiments. Further, while advantages associated with certain embodiments of the disclosed technology have been described in the context of those embodiments, other embodiments may also exhibit such advantages, and not all embodiments need necessarily exhibit such advantages to fall within the scope of the disclosed technology. Accordingly, the disclosure and associated technology can encompass other embodiments not expressly shown or described herein. The following statements are directed to embodiments of the present disclosure.

The invention claimed is:

1. A device for attaching a male coaxial cable connector to a female coaxial cable connector, the device comprising:
- a gripping member configured to receive a rotatable ring of the male coaxial cable connector; and
- a ground continuity element configured to be at least partially inserted into the gripping member, wherein the ground continuity element includes:
  - a ring portion;
  - a first tine extending from the ring portion, wherein the first tine includes a first surface configured to conductively contact the rotatable ring of the male coaxial cable connector; and
  - a second tine extending from the ring portion, wherein the second tine includes a second surface configured to conductively contact an outer surface of the male coaxial cable connector axially spaced from the rotatable ring of the male coaxial cable connector.

2. The device of claim 1 wherein the gripping member includes a hollow body configured to receive a portion of the male coaxial cable connector.

3. The device of claim 1 wherein the gripping member includes a wrench portion having a hexagonal inner surface.

4. The device of claim 1 wherein the first surface comprises two angled surfaces that define a V-shaped indentation in the first tine.

5. The device of claim 1 wherein the first tine extends from a first location on the ring portion, wherein the second tine extends from a second location on the ring portion, and wherein the first location is opposite the second location.

6. The device of claim 1 wherein the ground continuity element has a longitudinal axis extending through the ring portion and between the first tine and the second tine, and wherein the first surface of the first tine is axially spaced from the second surface of the second tine relative to the longitudinal axis of the ground continuity element.

7. The device of claim 1 wherein the second surface is configured to conductively contact a sleeve assembly of the male coaxial cable connector.

8. A device for facilitating grounding continuity across a first coaxial cable connector and a second coaxial cable connector, the device comprising:
- a conductive body, wherein the conductive body extends axially between a proximal end portion and a distal end portion, and wherein the conductive body includes:
  - a plurality of first engagement features, wherein the plurality of first engagement features are configured to conductively contact a rotatable ring of the first coaxial cable connector; and
  - a plurality of second engagement features, wherein the plurality of second engagement features are configured to conductively contact a sleeve assembly of the first coaxial cable connector, and wherein the plurality of first engagement features are axially spaced from the plurality of second engagement features; and
- means for gripping the first coaxial cable connector, wherein the means for gripping includes a hollow body configured to receive at least a portion of the conductive body and at least a portion of the first coaxial cable connector therein.

9. The device of claim 8 wherein the means for gripping is further configured to facilitate rotational attachment of the first coaxial cable connector to the second coaxial cable connector.

10. The device of claim 8 wherein the conductive body further includes a ring portion and a plurality of tines extending from a rear surface of the ring portion, and wherein the plurality of tines includes the second engagement features.

11. The device of claim 8 wherein the plurality of first engagement features and the plurality of second engagement features individually comprise V-shaped protrusions.

12. The device of claim 8 wherein the conductive body further includes:
- a ring portion; and
- a first tine and a second tine extending from the ring portion, wherein the first tine includes at least one of the plurality of first engagement features, and wherein the second tine includes at least one of the plurality of second engagement features.

13. The device of claim 12 wherein the first tine extends from a first location on the ring portion, wherein the second tine extends from a second location on the ring portion, and wherein the first location is opposite the second location.

14. The device of claim 12 wherein the conductive body has a longitudinal axis extending through the ring portion and between the first tine and the second tine, and wherein at least one of the plurality of first engagement features is axially spaced from at least one of the second engagement features on the second tine relative to the longitudinal axis of the conductive body.

15. A male coaxial cable connector, comprising:

a connecting ring having a first outer surface;

a cylindrical portion axially spaced from the connecting ring and having a second outer surface;

a ground continuity element configured to conductively contact the first and second outer surfaces; and a gripping member at least partially surrounding the connecting ring and the ground continuity element.

16. The cable connector of claim 15 wherein the ground continuity element comprises a metal plate.

17. The cable connector of claim 15 wherein the ground continuity element is attached to the gripping member.

18. The cable connector of claim 15 wherein the gripping member includes an inner surface comprising a groove configured to receive a portion of the ground continuity element and to retain the ground continuity element within the gripping member.

19. The cable connector of claim 15 wherein the gripping member comprises a removable clamshell.

20. The cable connector of claim 15 wherein the ground continuity element has an annular shape.

21. The cable connector of claim 15 wherein the gripping member includes an inner surface, wherein the inner surface comprises a plurality of flat surface portions circumferentially arranged therearound, and wherein the individual flat surface portions are configured to receive corresponding flat surfaces on the connecting ring.

22. An electrical connector, comprising:

a sleeve assembly having opposite first and second ends, the first end configured to be attached to an end portion of a coaxial cable;

a rotatable connector ring at the second end of the sleeve assembly; and a gripping member configured to surround at least a portion of the sleeve assembly and at least a portion of the connector ring, the gripping member including— a wrench portion configured to receive the at least a portion of the connector ring;

an outer surface comprising one or more grip portions; and an inner surface having at least one ground continuity element, wherein the ground continuity element contacts the connector ring and the sleeve assembly, thereby creating a grounding path between the sleeve assembly and the connector ring.

23. The electrical connector of claim 22 wherein the ground continuity element has a connector ring contact surface and a sleeve assembly contact surface, wherein the connector ring contact surface is configured to engage a surface of the connector ring, and wherein the sleeve assembly contact surface is configured to engage a surface of the sleeve assembly.

24. The electrical connector of claim 22 wherein the ground continuity element comprises a metal segment.

25. The electrical connector of claim 22 wherein the gripping member comprises a conductive material.

26. The electrical connector of claim 22 wherein the inner surface of the gripping member includes a retaining member, and wherein the ground continuity element is located on or near the retaining member.

27. The electrical connector of claim 26 wherein the retaining member is a lip formed along the inner surface of gripping member.

28. The electrical connector of claim 22 wherein the ground continuity element includes a ring portion and a tine extending therefrom, and wherein the tine includes a protrusion configured to engage the outer surface of the connector ring proximate the second end of the sleeve assembly.

29. The electrical connector of claim 28 wherein the ground continuity element has a connector ring contact surface and a sleeve assembly contact surface, wherein the connector ring contact surface is configured to engage an outer surface of the connector ring, and wherein the sleeve assembly contact surface is configured to engage an outer surface of the sleeve assembly.

30. The electrical connector of claim 28 wherein the ground continuity element has a length sufficient to span a gap between the connector ring and the sleeve assembly.

31. The electrical connector of claim 28 wherein the ground continuity element includes a ring body.

32. The electrical connector of claim 28 wherein the ring body is configured to engage a retaining member on the inner surface of the gripping member.

33. The electrical connector of claim 28 wherein the ring body includes a connector ring contact surface configured to conductively engage the connector ring, and further includes a sleeve assembly contact surface configured engage an outer surface of the sleeve assembly.

34. The electrical connector of claim 28 wherein the ring body is U-shaped in cross-section.

35. The electrical connector of claim 33 wherein the ring body includes a plurality of tines; and wherein the sleeve assembly contact surface is on at least one of the tines.

* * * * *